US008394238B2

(12) United States Patent
Evangelisti

(10) Patent No.: US 8,394,238 B2
(45) Date of Patent: Mar. 12, 2013

(54) APPARATUS AND METHOD FOR MANUFACTURING SECURITY PAPER

(75) Inventor: Giancarlo Evangelisti, Fabriano (IT)

(73) Assignee: Cartiere Fedrigoni E C. S.p.A., Arco (IT)

( * ) Notice: Subject to any disclaimer, the term of this patent is extended or adjusted under 35 U.S.C. 154(b) by 85 days.

(21) Appl. No.: 11/628,077

(22) PCT Filed: Jun. 16, 2005

(86) PCT No.: PCT/EP2005/006477

§ 371 (c)(1),
(2), (4) Date: Nov. 30, 2006

(87) PCT Pub. No.: WO2005/124023

PCT Pub. Date: Dec. 29, 2005

(65) Prior Publication Data

US 2008/0179026 A1 Jul. 31, 2008

(30) Foreign Application Priority Data

Jun. 16, 2004 (IT) ..... VR2004A0104

(51) Int. Cl.

| | |
|---|---|
| ***D21H 23/50*** | (2006.01) |
| ***D21H 23/20*** | (2006.01) |
| ***D21H 21/40*** | (2006.01) |
| ***D21F 1/60*** | (2006.01) |
| ***D21F 1/48*** | (2006.01) |
| ***D21F 13/04*** | (2006.01) |

(52) U.S. Cl. ..... 162/266; 162/268; 162/298; 162/318; 162/323; 162/363

(58) Field of Classification Search ..... 162/123, 162/132, 140, 265–268, 298, 300, 304, 318, 162/321–323, 363–373; 283/94, 98, 72, 283/74

See application file for complete search history.

(56) References Cited

U.S. PATENT DOCUMENTS

| | | | | | |
|---|---|---|---|---|---|
| 61,321 | A | * | 1/1867 | Crane | 283/98 |
| 987,678 | A | * | 3/1911 | Howes | 162/126 |
| 3,287,207 | A | * | 11/1966 | Treat | 162/186 |
| 3,560,334 | A | * | 2/1971 | Arledter | 162/266 |
| 4,552,617 | A | * | 11/1985 | Crane | 162/103 |
| 4,761,205 | A | * | 8/1988 | Crane | 162/103 |
| 5,020,581 | A | | 6/1991 | Gutierrez et al. | |
| 5,409,575 | A | * | 4/1995 | Savia et al. | 162/301 |
| 5,567,276 | A | * | 10/1996 | Boehm et al. | 162/103 |

(Continued)

FOREIGN PATENT DOCUMENTS

| | | | |
|---|---|---|---|
| EP | 0 229 645 | A | 7/1987 |
| EP | 0 492 407 | A | 7/1992 |

(Continued)

*Primary Examiner* — Jose A Fortuna
(74) *Attorney, Agent, or Firm* — Modiano & Associati; Daniel O'Byrne; Albert Josif

(57) ABSTRACT

An apparatus for manufacturing security paper, comprising at least one main forming roller, which is provided with a lower portion or forming portion, which is arranged inside a forming box that contains a paper paste, an upper portion or deposition portion, which is arranged below a collecting wire that can move along an advancement direction and is designed to receive, at a collecting face, the sheet formed on the forming roller, and a device for depositing security elements that is arranged upstream of the main forming roller along the advancement direction of the collecting wire and is adapted to deposit the security elements at the collecting face.

4 Claims, 4 Drawing Sheets

U.S. PATENT DOCUMENTS

| | | | | |
|---|---|---|---|---|
| 5,897,746 | A * | 4/1999 | Attenberger et al. | 162/140 |
| 5,989,389 | A | 11/1999 | Sundberg et al. | |
| 6,936,138 | B2 * | 8/2005 | Attenberger et al. | 162/265 |
| 7,128,272 | B2 * | 10/2006 | Doublet | 235/492 |
| 7,347,917 | B2 * | 3/2008 | Ash et al. | 162/140 |
| 2002/0166647 | A1 * | 11/2002 | Attenberger et al. | 162/135 |
| 2005/0011624 | A1 * | 1/2005 | Korhonen et al. | 162/205 |
| 2005/0016702 | A1 * | 1/2005 | Ash et al. | 162/140 |
| 2005/0224203 | A1 * | 10/2005 | Boehm et al. | 162/140 |
| 2008/0179026 | A1 * | 7/2008 | Evangelisti | 162/140 |
| 2009/0001709 | A1 * | 1/2009 | Kretschmar et al. | 283/94 |
| 2009/0033914 | A1 * | 2/2009 | Doublet | 356/71 |
| 2011/0214828 | A1 * | 9/2011 | Le Loarer | 162/140 |

FOREIGN PATENT DOCUMENTS

| | | | |
|---|---|---|---|
| EP | 0 509 561 | A | 10/1992 |
| EP | 0 860 298 | A | 8/1998 |
| GB | 741 675 | A | 12/1955 |
| GB | 2 390 056 | A | 12/2003 |
| WO | WO 9420679 | A1 * | 9/1994 |
| WO | WO 03/023140 | A | 3/2003 |
| WO | WO 2004/043706 | A | 5/2004 |

* cited by examiner

APPARATUS AND METHOD FOR MANUFACTURING SECURITY PAPER

TECHNICAL FIELD

The present invention relates to an apparatus for manufacturing security paper or forgery-resistant paper and to the corresponding method.

BACKGROUND ART

It is known that certain types of security papers (used typically to manufacture banknotes, checks, papers for identity documents or passports, etc) are provided with several security devices, which usually include a watermark and/or a security thread.

Some kinds of forgery-resistant papers often have, in addition to the "classic" security devices mentioned above, additional security elements, constituted for example by so-called "plachettes", fibers, filaments having different shapes, sizes, or granules that can be fluorescent, luminescent, magnetic, magnetizable etc, having various dimensions, sometimes even on the order of 10 micrometers.

These security elements are generally embedded within the sheet (at respective application regions) during its formation, by using feeder devices that are immersed in the forming box that contains the paper paste and within which the forming roller rotates.

Such feeder devices are constituted generally by so-called "spreaders", which are provided with an internal chamber connected, by means of an intake port, to a duct for feeding the security elements, which are usually diluted in water and are contained within a containment tank.

The spreaders are further provided with a feeding opening, which faces a portion of the outer blanket of the roller, immersed in the forming box, so that the security elements that exit from the feeding opening can be deposited simultaneously with the paper paste onto the outer surface (wire) of the roller during the formation of the sheet.

In security paper manufacturing plants there is a collecting wire in order to allow the separation of the sheet from the wire of the forming roller.

The sheet of paper formed on the rotating forming roller is transferred onto the collecting wire and contains all the security elements applied also with the aid of suction means, which produce an appropriate partial vacuum inside the forming roller.

In some plants there is an additional forming roller or former, which is arranged, along the paper production line, upstream of the forming roller (main watermarking roller), which in a manner substantially similar to what has been described for the forming roller forms a first layer, termed vellum, having a very fine grammage, which will be attached to the surface of the collecting wire (before said wire is arranged at the forming roller), and the wire itself deposits it on the second layer obtained on the forming roller.

The two sheets, while wet, then form a single so-called two-ply sheet.

As mentioned earlier, spreaders for depositing the security elements must currently be arranged so that they are more or less immersed in the forming box, and this causes drawbacks.

In order to try to avoid problems during printing, such as partial separation of the security elements as a consequence of the action of the printing elements, with consequent soiling of the plates, the deposition of the security elements must be performed simultaneously with the deposition of a layer of paste on the forming roller.

For this reason, the spreader or spreaders must be properly adjusted and positioned at an appropriate depth within the forming box. However, this condition prevents monitoring (including visual monitoring) of the deposition of the security elements.

Moreover, any variation in the operating conditions within the forming box (density of the paste, partial vacuum inside the roller, etc) may determine a change in the conditions of deposition of the security elements (such as width of the band, density of the elements) that are difficult to detect in line, both due to the difficulty of accessing the deposition region and due to the fact that the security elements that are inserted often are not easily visible in transmitted light or in reflected light.

DISCLOSURE OF THE INVENTION

The aim of the present invention is to provide an apparatus for manufacturing security paper provided with security elements that is capable of eliminating or in any case reducing drastically the drawbacks noted above in the devices currently in use.

Within this aim, an object of the present invention is to provide an apparatus for manufacturing security paper that can offer high reliability in operation.

Another object of the invention is to provide a method for manufacturing security paper that allows to obtain a security paper that can be printed easily.

Another object of the present invention is to provide a method for manufacturing security paper that allows to control precisely and reliably the width, density and region of deposition of the security elements.

This aim and these and other objects that will become better apparent hereinafter are achieved by an apparatus for manufacturing security paper according to the present invention, comprising at least one main forming roller, which is provided with a lower portion or forming portion, which is arranged inside a forming box that contains the paper paste, and an upper portion or deposition portion, which is arranged below a collecting wire that can move along an advancement direction and is designed to receive, at a collecting face, the sheet formed on said forming roller, characterized in that it comprises a device for depositing security elements that is arranged upstream of the main forming roller along the advancement direction of the collecting wire and is adapted to deposit the security elements at the collecting face.

According to another aspect, the present invention provides a method for manufacturing security paper comprising the steps of:

depositing security elements at least one deposition region defined on the collecting face of a collecting wire, transferring, on top of said security elements, a layer of paper on said collecting wire.

BRIEF DESCRIPTION OF THE DRAWINGS

Further characteristics and advantages of the invention will become better apparent from the description of some preferred but not exclusive embodiments of an apparatus according to the invention, illustrated by way of non-limiting example in the accompanying drawings, wherein.

WAYS OF CARRYING OUT THE INVENTION

Figure 1:
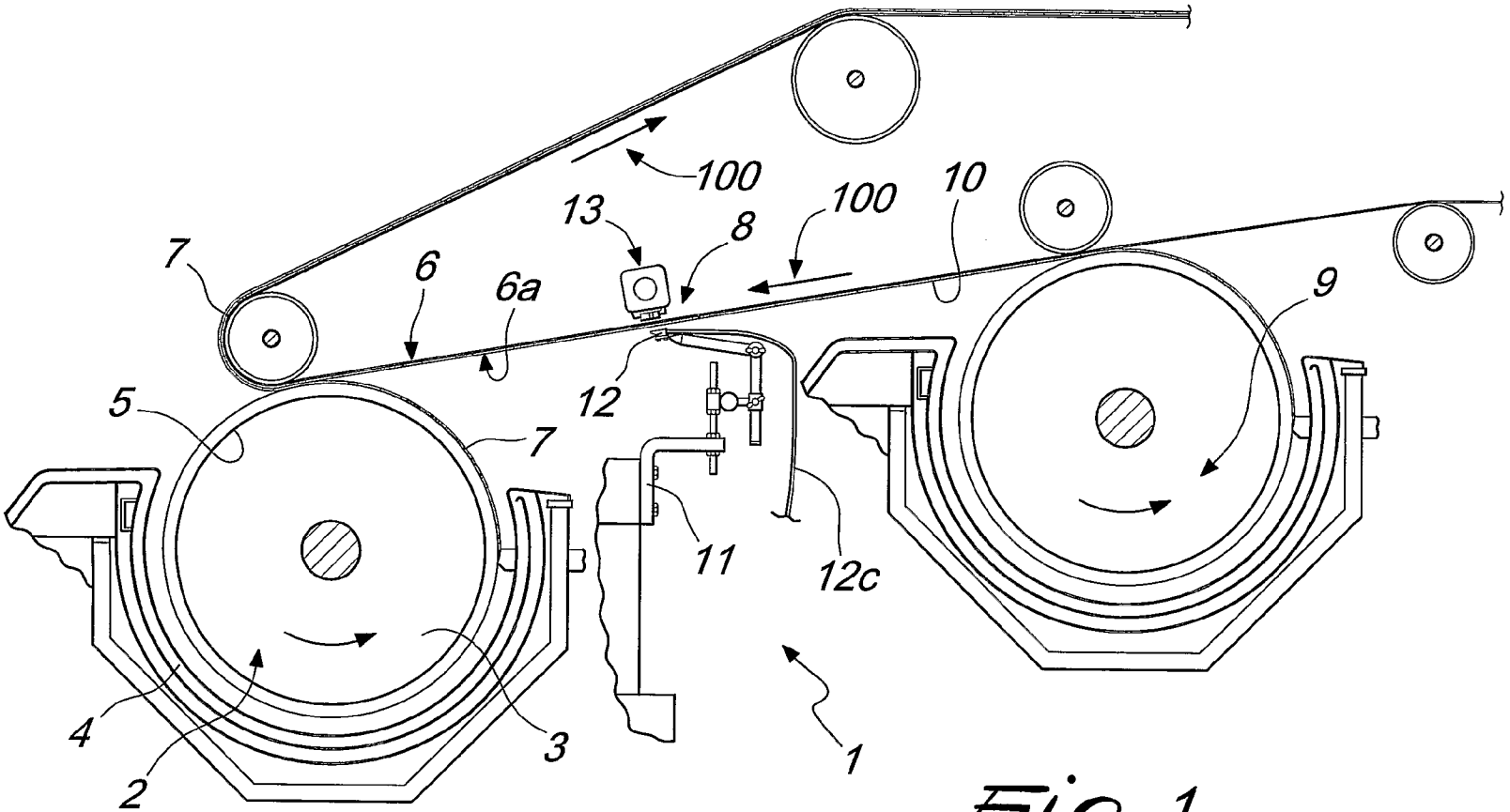
FIG. 1 is a longitudinal sectional view of an apparatus for manufacturing security paper according to the present invention.

In the examples of embodiments that follow, individual characteristics, given in relation to specific examples, may actually be interchanged with other different characteristics that exist in other examples of embodiments.

Moreover, it is noted that anything found to be already known during the patenting process is understood not to be claimed and to be the subject of a disclaimer.

With reference to the figures, an apparatus for manufacturing security paper 200, generally designated by the reference numeral 1, comprises at least one main forming roller 2, which is provided with a lower or forming portion 3, arranged inside a first forming box 4, which contains the paper paste, and an upper or deposition portion 5, which is arranged below a collecting wire 6.

In particular, the collecting wire 6 can move along an advancement direction (indicated by the arrow 100) and is designed to receive, at a collecting face 6*a*, the sheet 7 formed at the outer blanket of the main forming roller 2.

According to the present invention, the apparatus 1 is provided with a device 8 for depositing security elements 201, arranged upstream of the main forming roller 2 along the advancement direction 100 of the collecting wire 6.

In particular, the deposition device 8 is adapted to deposit the security elements 201 at the collecting face 6*a* of the collecting wire 6.

Advantageously, with reference to the embodiment shown in FIG. 1, the apparatus 1 may have, upstream of the deposition device 8, a secondary forming roller or former 9, which is adapted to deposit on the collecting wire 6 (and particularly on its collecting face 6*a*) a vellum layer 10 of paper, so as to obtain a so-called two-ply security paper.

It is evident that in this case the device 8 for depositing the security elements 201 is adapted to deposit the security elements at the vellum layer 10 conveyed by the collecting wire 6.

Figure 8:
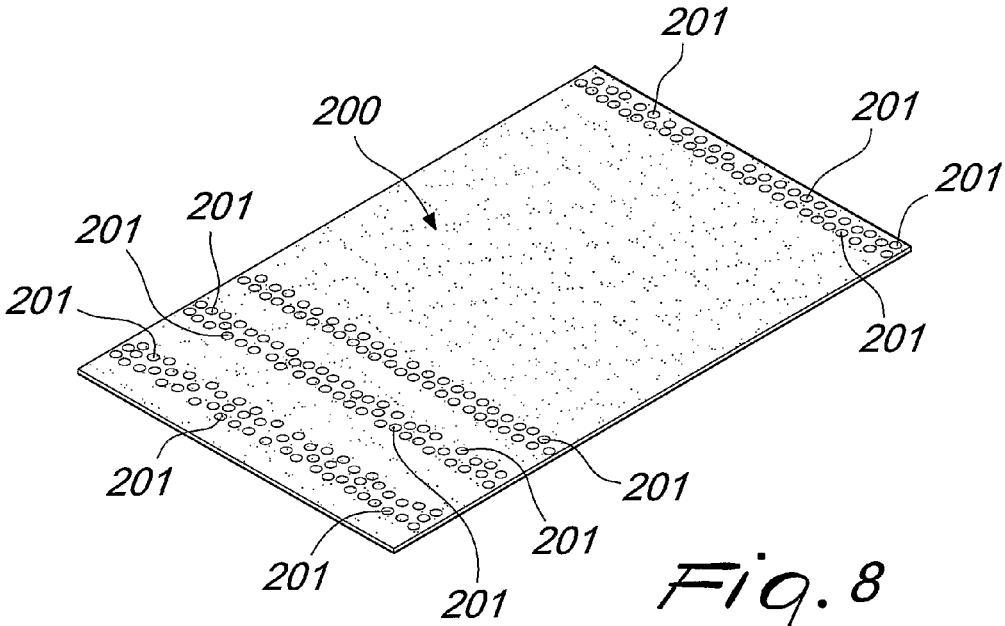
FIG. 8 is a perspective view of a security paper provided with security elements.
Figure 9:
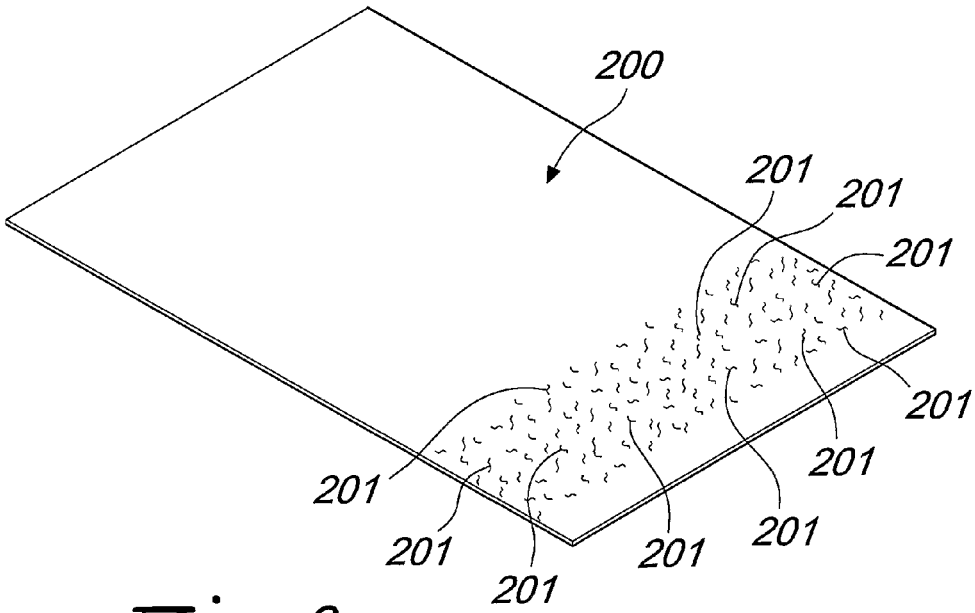
FIG. 9 is a view, similar to FIG. 8, of a further embodiment.

Advantageously, the deposition device 8 comprises a supporting structure 11 for at least one feeder or spreader 12, which is arranged below the collecting wire 6 and has at least one intake port 12*a*, which is connected to a duct 12*c* for feeding the security elements 201 (see FIGS. 8 and 9), and at least one feeding opening 12*b* which, during use, substantially faces the collecting face 6*a* of the collecting wire 6.

Conveniently, the feeding opening 12*b* has a substantially rectangular shape that is elongated along the advancement direction.

In greater detail, the deposition device 8 can be constituted by a plurality of feeders 12, which are spaced along a direction that is substantially transverse to the advancement direction 100 of the collecting wire 6.

Conveniently, the deposition device 8 comprises a suction device 13, which is arranged on the opposite side of the collecting wire 6 with respect to the feeder or feeders 12, and is provided with a suction or intake port that at least faces the feeding opening 12*b*.

Figure 2:
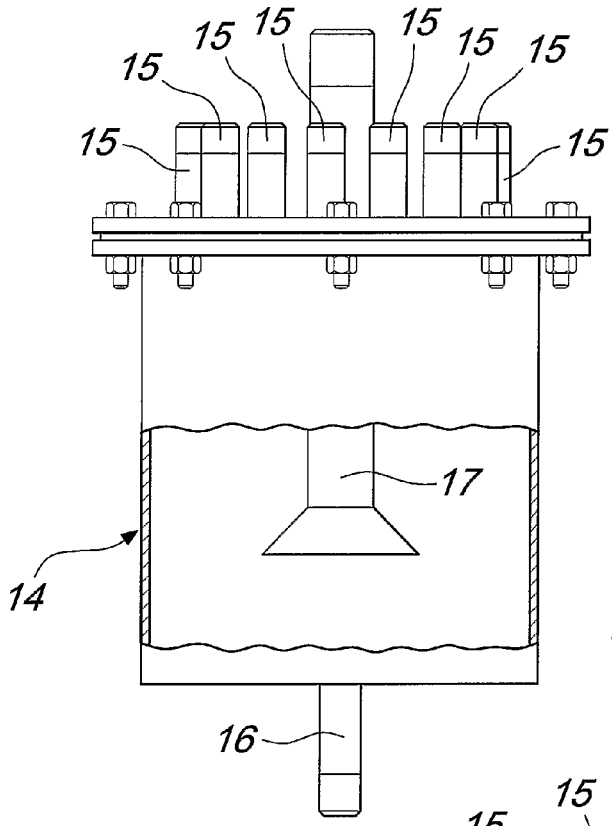
FIG. 2 is a partially sectional elevation view of a diffuser.
Figure 3:
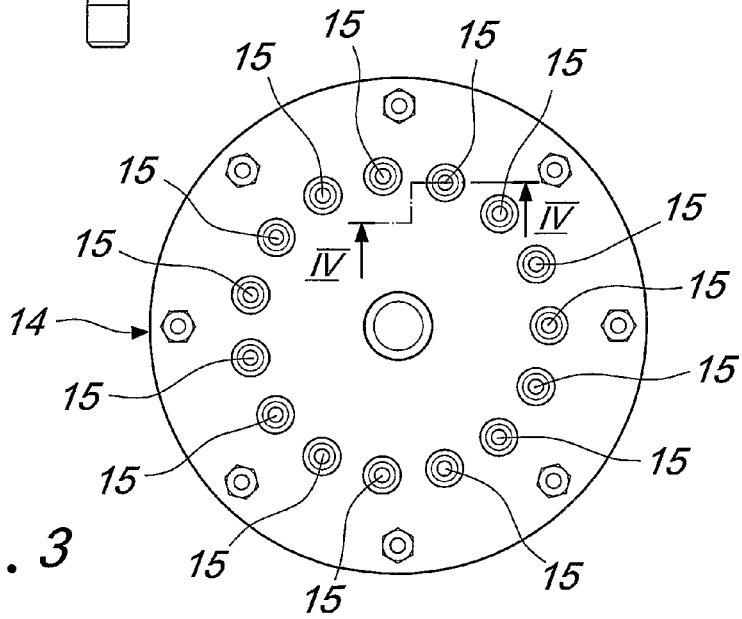
FIG. 3 is a top plan view of the diffuser shown in FIG. 2.
Figure 4:
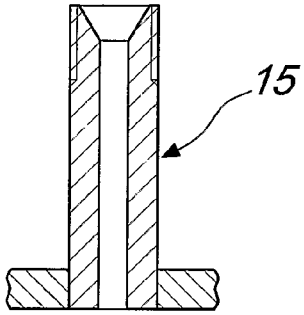
FIG. 4 is a sectional view, taken along the line IV-IV, of FIG. 3.
Figure 5:
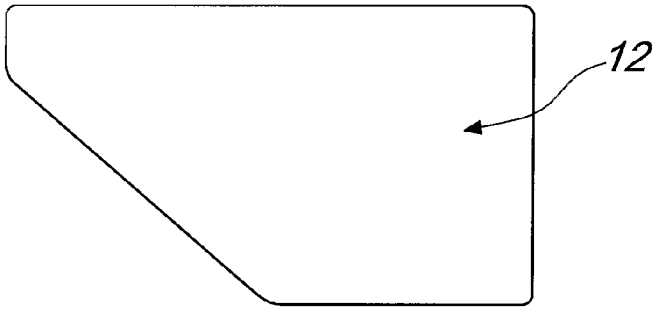
FIG. 5 is a side elevation view of a feeder.
Figure 6:
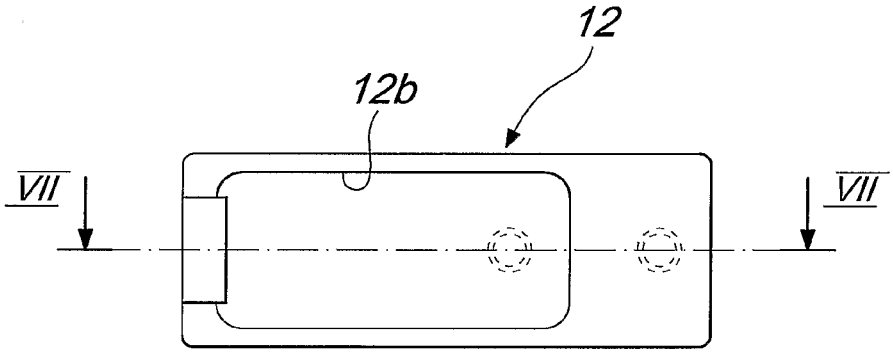
FIG. 6 is a top plan view of the feeder shown in FIG. 5.
Figure 7:
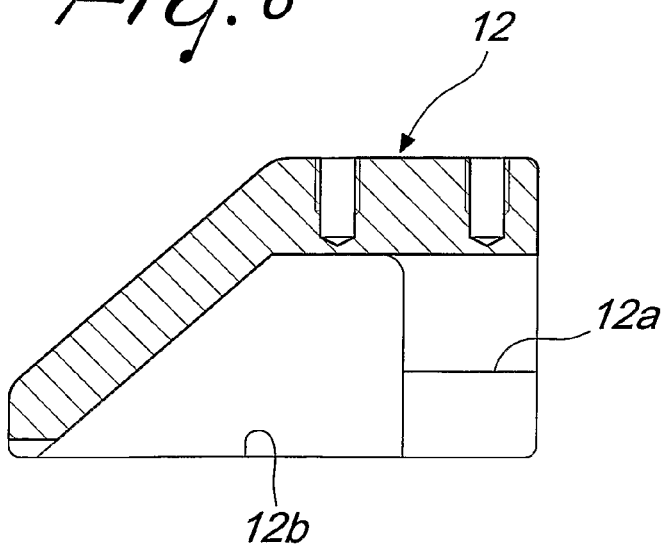
FIG. 7 is a sectional view of the feeder, taken along the line VII-VII of FIG. 6.

With particular reference to FIGS. 2 to 4, the deposition device 8 can be provided with at least one diffuser 14, which can be connected in output to each feeding duct 12*c* at a respective output manifold 15 and can be connected in input (at an input manifold 16) to a tank for containing an aqueous solution of the security elements 201.

In order to allow adequate control of the transfer of the aqueous solution to the feeders 12, adjustment means are provided for adjusting the pressure of the solution inside the diffuser 14, so as to allow control of the flow-rate of the solution in output from the feeding opening or openings 12*b*.

According to a preferred embodiment, the adjustment means comprise a pump that is adapted to feed a mixture of the aqueous solution and air to the diffuser 14 by means of the input manifold 16.

Conveniently, the diffuser 14 is provided with a discharge valve 17, which can be connected to a discharge duct that is connected to the containment tank, so as to be able to recover any aqueous solution of security elements.

According to a further aspect, the present invention provides a method for manufacturing security paper comprising the steps of:

depositing security elements at least one deposition region defined on the collecting face of a collecting wire;

transferring, on top of said security elements, a layer of paper on said collecting wire.

According to a preferred embodiment, if a two-ply security paper is to be obtained, it is possible to provide, before the step of depositing the security elements, a step of transferring a vellum layer at the collecting face of the collecting wire, the step of depositing the security elements being performed at the vellum layer.

Merely by way of example, the vellum layer 10 can have a grammage comprised between 10 and 25 g/m$^2$, preferably comprised between 15 and 20 g/m$^2$.

The total grammage of the security paper, after the deposition of the second layer by the main forming roller 2, can be comprised between 60 and 120 g/m$^2$, advantageously between 75 and 115 g/m$^2$.

Operation of an apparatus for manufacturing security paper according to the invention is as follows.

If two-ply security paper is to be produced, the secondary forming roller or former 9 deposits, on the collecting face 6*a* of the collecting wire 6, a vellum layer 10, on top of which the deposition device 8 deposits the security elements at respective deposition regions, which in the example shown and described earlier are arranged longitudinally with respect to the advancement direction of the collecting wire 6 and have a width (transverse dimension) that is substantially equal to (or slightly larger than) the width of the feeding opening 12*b*.

The suction device 13 forces the adhesion of the security elements to the vellum layer 10, with consequent aspiration of the water and of any additives contained in the solution fed to the feeders 12.

The main forming roller 2 deposits the second layer of paper, which is often but not necessarily provided with a watermark, on top of the vellum layer 10 and the security elements deposited by the feeders 12.

As mentioned earlier, nothing prevents the use of the method (and of the apparatus) described above to obtain a single-layer security paper. In this case, one avoids depositing the vellum layer 10 on the collecting wire.

All the characteristics of the invention described above as advantageous, convenient or the like may also be omitted or be replaced with equivalents.

The invention thus conceived is susceptible of numerous modifications and variations, all of which are within the scope of the appended claims.

In practice it has been found that the apparatus for manufacturing security paper thus described allows to achieve the intended aim and objects.

In particular, it has been found that it allows to control precisely and effectively the deposition of the security elements.

The arrangement of the device for depositing the security elements outside the forming box in fact allows to control and act immediately on said device.

Moreover, since the feeders are outside the forming box, control of the deposition parameters (density of the elements, feed pressure, etc) is facilitated, and most of all is independent of the conditions of deposition of the paper paste on the outer blanket of the main forming roller 2.

In practice, the materials used, so long as they are compatible with the contingent use, as well as the shapes and dimensions, may be any according to requirements.

Thus, for example, the security elements can be constituted by so-called plachettes, but also by fibers with filaments or by granules that can be fluorescent, luminescent, magnetic, magnetizable, etc, of various sizes (comprised between microns and hundreds of microns) and shapes, as well as by threadlike elements of various widths, thicknesses and shapes.

Moreover, all the details may be replaced with other technically equivalent elements.

The invention clamed is:

1. An apparatus for manufacturing security paper, comprising at least one main forming roller, which is provided with a lower portion or forming portion, which is arranged inside a forming box that contains a paper paste, and an upper portion or deposition portion, which is arranged below a collecting wire that moves along an advancement direction for receiving, at a collecting face, a sheet formed on said forming roller, further comprising a device for depositing security elements that is arranged upstream of said main forming roller along the advancement direction of said collecting wire and is adapted to deposit said security elements at said collecting face, wherein said device for depositing security elements comprises a supporting structure for at least one feeder or spreader, which is arranged below said collecting wire and is provided with at least one intake port connected to a duct for feeding said security elements and at least one feeding opening, which is arranged so that it substantially faces said collecting face of said collecting wire, and wherein said device for depositing security elements comprises at least one diffuser, which is connected at its output to each feeding duct and at its input to a tank for containing an aqueous solution of said security elements, pumping means being provided for adjusting the pressure of said solution inside said diffuser in order to control the flow-rate of said solution in output from said feeding openings, wherein said device for depositing security elements comprises a suction device, which is arranged on an opposite side of said collecting wire with respect to said feeder and is provided with an intake or suction port that at least faces said feeding opening, and wherein a discharge valve is arranged inside said diffuser, said valve being connected to a discharge duct connected to said tank, so as to be able to recover any aqueous solution of security elements that remains in the diffuser.

2. The apparatus according to claim 1, further comprising, upstream of said deposition device, a secondary forming roller or former, which is adapted to deposit on said collecting wire a layer of paper, said device for depositing said security elements being adapted to deposit said security elements on said layer of paper conveyed by said collecting wire.

3. The apparatus according to claim 1, wherein said device for depositing security elements comprises a plurality of said feeders, which are spaced along a direction that is substantially transverse with respect to said advancement direction of said collecting wire.

4. The apparatus according to claim 1, wherein said pumping means comprise a pump that is adapted to feed a mixture of said aqueous solution and air to said diffuser.

* * * * *